United States Patent [19]

Buchschmid et al.

[11] Patent Number: 4,494,101

[45] Date of Patent: Jan. 15, 1985

[54] ELECTRICAL WINDING ON FIXED-MOUNT LAMINATED IRON CORE SUBJECT TO SHAKING

[75] Inventors: Emil Buchschmid, Rosstal; Friedrich Horn, Lichtenau; Bruno Nieberl, Zirndorf; Hans-Jörg Schmidt, Feucht; Manfred Weyerich, Oberasbach, all of Fed. Rep. of Germany

[73] Assignee: Robert Bosch GmbH, Stuttgart, Fed. Rep. of Germany

[21] Appl. No.: 470,253

[22] Filed: Feb. 28, 1983

[30] Foreign Application Priority Data

Mar. 23, 1982 [DE] Fed. Rep. of Germany ... 8208150[U]

[51] Int. Cl.[3] ..... H01F 27/26

[52] U.S. Cl. ..... 336/210; 310/216; 336/234

[58] Field of Search ..... 310/216, 217, 218; 336/210, 233, 234, 216, 217

[56] References Cited

U.S. PATENT DOCUMENTS

| | | | |
|---|---|---|---|
| 2,671,951 | 3/1954 | Sliwiak | 336/234 |
| 2,975,312 | 3/1961 | Ploran | 310/217 |
| 3,127,581 | 3/1964 | Rasmussen | 336/210 X |
| 3,387,245 | 6/1968 | Czernobil | 336/234 |

FOREIGN PATENT DOCUMENTS

| | | | |
|---|---|---|---|
| 7003143 | 7/1971 | Fed. Rep. of Germany . | |
| 1044525 | 10/1966 | United Kingdom | 336/234 |

*Primary Examiner*—Thomas J. Kozma

*Attorney, Agent, or Firm*—Frishauf, Holtz, Goodman & Woodward

[57] ABSTRACT

The laminations of a stack that form an iron core for a magneto armature are provided with wart-like deformations produced by through-stamping, so that pressing the stack together will provide a press-fit at the locations of the deformations. The core is mounted by screws through mounting holes respectively in the yoke and at the end of one leg of an E-shaped core, while the press-fits produced by superposed deformations hold the rest of the core together against warping and twisting. Protuberances from the annular cup casing, which contains the winding mounted on the middle leg of the core, grasp the lamination stack in a region remote from the mounting holes to prevent the press-fit locking of the laminations from loosening.

16 Claims, 3 Drawing Figures

ELECTRICAL WINDING ON FIXED-MOUNT LAMINATED IRON CORE SUBJECT TO SHAKING

This invention concerns an electrical winding on a laminated iron core such as is used for the ignition armature affixed to an internal combustion engine and forming part of a magneto generator. The laminated core of such a device usually has several mounting holes so that it can be screwed down on the engine housing or block. The winding is usually embedded in an annular cup of plastic and pushed onto a leg of the core.

In a known ignition armature, described in DE-GM 70 03 143, the windings are disposed on an E-shaped iron core and embedded in a casting material within a cup made of insulating material. The iron core consists of layered sheet iron laminations which are held together by rivets and fastening screws. The screws are inserted in mounting holes in the iron core and screwed into the casing of the engine.

It is also known, in order to provide sufficient stiffness against warping of the iron core, to hold the laminations together firmly by rivets, clips, welds or other fastening means.

The known ways of providing stiffness and solidity have the disadvantage that these fastening means are expensive and troublesome to provide, and stick out beyond the surface of the outermost laminations, so that when the electrical windings are applied, a corresponding air gap must be provided for seating them on a leg of the iron core. If such an air gap is to be reduced to a minimum and the windings disposed as closely as possible on the core, then the laminations must be fastened together by rivets or screws after the windings are put on.

It is further known from U.S. Pat. No. 2,975,312, to clip the laminations of iron cores together by wart-like interfitting coined bosses. In order to prevent the laminations from loosening themselves again during operation as the result of shaking stresses, the iron core of the embodiment just mentioned is cast into the flywheel casing of the magneto.

THE INVENTION

It is an object of this invention to hold together the laminations of an iron core for electrical windings without supplementary fastening means as simply as possible and with optimum stiffness against twisting and warping, even in the regions thereof where there are no mounting holes for connecting the core to a bracket or substrate.

Briefly, the laminations are mutually clipped together by identical interfitting deformations and at least one core leg, which has no mounting holes, is held on opposite sides by protuberances provided on the cup containing the winding, there holding the stacked laminations together. It is particularly advantageous for one of the laminations at the outside of the stack to have a clear aperture instead of an embossed deformation, engaging the correspondingly located deformation of the adjacent lamination, so as to avoid any projection beyond the surface of the lamination stack.

The invention has the advantage, accordingly, that no fastening elements extend beyond the surface of the lamination stack, so that the electrical windings can be pushed onto the smooth core. Besides, the individual laminations are held together in a warp-proof manner without supplementary fastening means, even in the regions in which no fastening screws are inserted. Instead, the laminations are clipped face-to-face by their deformations and are engaged by the protuberances of the containing cup of the winding in this region to such an extent that the laminations cannot loosen themselves again. The iron core thus becomes highly stable, stiff and warp-resistant. It can also be economically machined.

A particularly high resistance to warping can be obtained for an E-shaped iron core when the laminations are respectively provided with deformations constituted as stamped-through warts at at least one location in the yoke of the core, as well as in the legs.

THE DRAWING

The invention is further described by way of illustrative example with reference to the annexed drawing, in which.

DESCRIPTION OF THE ILLUSTRATED EMBODIMENT

Figure 1:
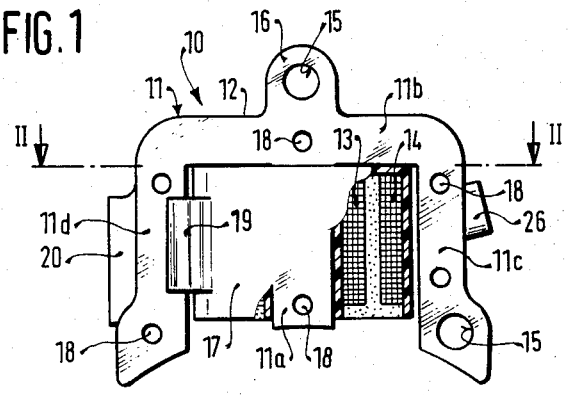
FIG. 1 is a side elevation view partly broken away. of an ignition armature for a magneto ignition system.

In FIG. 1, the ignition armature of an internal combustion ignition system is designated as a unit with the numeral 10. It consists of an E-shaped iron core 11 of stacked laminations 12, a primary winding 13 and a secondary winding 14, the windings being concentrically disposed one over the other around the central core leg 11*a*. The iron core 11 has mounting holes 15 by which it can be screwed fast by machine screws to the casing of an engine which is not shown in the drawing. One mounting hole 15 is disposed in a projection 16 from the yoke 11*b* of the core, while the other mounting hole 15 is situated in the pole-piece of the right-hand core leg 11*c*. The primary and secondary windings 13 and 14 of the ignition armature 10 are inserted in a casing cup 17 of plastic and are embedded there in a potting or casting compound.

The individual laminations 12 of the core 11 are clipped together face-to-face by interfitting deformations 18 of the stacked laminations 12. In addition, the cup casing 17 is provided with protuberances which grasp the left-hand outer core leg 11*d* on both sides, so as to hold the stacked laminations 12 together where they are grasped. This left-hand core leg, like the middle leg 11*a*, has no mounting hole 15. The grasping of the core leg 11*d* by the cup casing 17 reliably prevents the laminations 12 from getting loose from each other at the interfitting deformations 18 that clip or brace them together.

Figure 2:
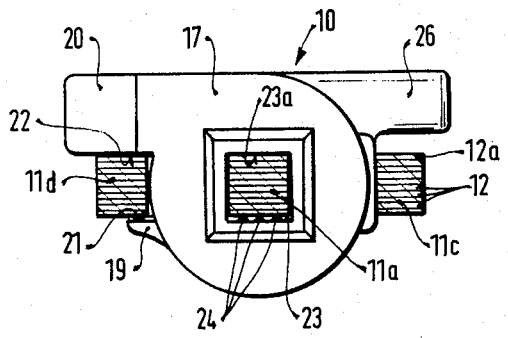
FIG. 2 is a cross-section through the line II—II of FIG. 1.

The two-sided grasping of the unscrewed core legs 11*a* and 11*d* can be seen in the plan view of the ignition armature 10 given in FIG. 2. The protuberances of the cup container 17 comprise on one side a bracket 19 and on the other side a pocket 20, in which the electronic components of the ignition system are disposed and potted in place. The bracket 19 is provided with a longitudinal rib 21 which presses the sheet iron laminations 12 together against a plane surface 22 of the pocket 20 of the cup casing structure 17. The middle core leg 11*a* fits into a chimney-like opening 23 in the middle of the cup casing 17, where it lies on one side against a smooth surface 23*a* of the casing. Such a winding casing is sometimes referred to as a "spool", even though it is not used in the manufacture of the winding, and the winding is simply slipped into it.

The casing 17 also has a tubular projection 26 for the electrical connections to the winding in which a connector (not shown) is set for the attachment of an ignition cable.

Figure 3:
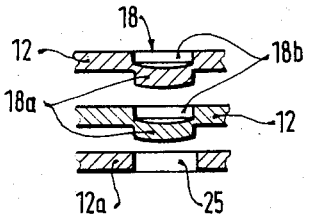
FIG. 3 is an exploded view of several sheet metal laminations of the stack forming an iron core which are provided with interfitting deformations.

FIG. 3 shows a cross-section through the lower sheet iron laminations 12 of the lamination stack, this figure showing only the region in which one of the deformations 18 appears in each lamination. The laminations 12 are shown spaced one above the other, merely for clarity since they are packed together tightly when stacked. The lowest lamination 12*a*, which is on the outside of the stack, has a clear opening 25 stamped through it, instead of a deformation like those of the other laminations above it. When the laminations 12 are stacked together. the deformations 18 of the overlying laminations engage in a force-fit into the cavity provided immediately below in the adjacent lamination.

The deformations 18 are constituted as warts produced by through-stamping, which have their height so chosen that the thickness of the last lamination 12*a* is not exceeded. In assembling the core 11. the laminations 12,12*a* are stacked one above the other and pressed together. The wart 18*a* of each overlying lamination 12 is pressed into the corresponding depression 18*b* of each underlying lamination 12, the wart 18*a* of the next-to-last lamination 12 being correspondingly pressed into the clear opening 25 of the last lamination 12*a*. In this manner, the core laminations 12,12*a* are held together by an overall press-fit. Since the deformations 18 do not extend out of the surface plane of the core 11, the laminations 12 can be clamped together with such deformations 18 also in the region of the middle core leg 11*a* which carries the primary and secondary windings 13 and 14. High stiffness of the core 11 against warping and twisting is produced when each of the laminations 12 has at least one wart-shaped deformation 18, in each of the respective regions of the three legs 11*a*, 11*c* and 11*d*, as well as in the region of the yoke 11*b* of the E-shaped core 11. In the embodiment illustrated in FIG. 1, two deformations 18 are provided in each of the outer legs 11*c* and 11*d*, one in the middle leg 11*a* and one in the yoke 11*b*.

The invention is not limited to the illustrated embodiment, since electrical windings equipped with an iron core can also be screwed fast in other configurations on a suitable base. What is essential is that the regions of the core, where the laminations are not held together by screws or other fastening means, are provided with deformations by which the laminations stacked upon each other are clamped together successively face-to-face and are likewise grasped together by protuberances of the casing structure for the electrical windings. It is thereby assured that on the one hand the core is held together in a warp-proof and twist-proof manner by the deformations of the laminations, and on the other hand a loosening of this connection by shaking during operation of the engine on which the device is mounted is prevented because the core in these regions is grasped securely by protuberances of the cup casing of the winding.

Although the invention has been described with respect to a particular illustrative embodiment, it will be understood that modifications and variations are possible within the inventive concept.

We claim:

1. Electrical winding for a magneto comprising a core of stacked sheet iron laminations, having a yoke and a plurality of legs and mounted on a base by fastening means passing through mounting holes, and a cup casing for the winding slipped onto a leg of said core, in which casing said winding is embedded, said laminations respectively having interfitting deformations of at least one set of identically shaped deformations by which they are force-fitted together face-to-face, one of said core legs being free of mounting holes and encompassing at least one said set of lamination deformations, and said cup casing having outward protuberations grasping said core leg which is free of mounting holes, on opposite sides thereof, so as to prevent spreading apart of said laminations in the neighborhood of said protuberations.

2. Electrical winding according to claim 1, in which said core stack of laminations also has an outer lamination (12*a*) having clear openings of contour conforming to that of deformations of the other laminations of said core, a said clear opening being provided at each location corresponding to the location of a said deformation on each of said other laminations, said additional lamination being force-fitted to the lamination of said core next adjacent thereto by the deformations of the latter.

3. Electrical winding according to claim 2, in which at least one said set of identically shaped deformations is provided in the respective portions of said laminations which constitute said leg (11*a*) of said core onto which said cup casing for said winding is slipped into place.

4. Electrical winding according to claim 3, in which at least one said set of deformations is provided in the respective regions of each of said core legs and in the region of said core yoke, said core being of E-shaped configuration, the deformations of said at least one set being in the form of stamped-through warts (18*a*).

5. Electrical winding according to claim 1, in which said core is E-shaped, having two outer legs and a middle leg, one of said outer legs being said leg which is free of mounting holes, and the middle leg being a leg of which said cup casing (17) of said winding is slipped on said cup casing being provided with a chimney-like opening of substantially rectangular cross-section for fitting over said middle core leg, a plurality of longitudinal internal ribs (24) being provided on one side of said chimney-like opening for pressing together said laminations at said middle core leg (11*a*).

6. Electrical winding according to claim 2, in which said core is E-shaped, having two outer legs and a middle leg, one of said outer legs being said leg which is free of mounting holes, and the middle leg being a leg on which said cup casing (17) of said winding is slipped on, said cup casing being provided with a chimney-like opening of substantially rectangular cross-section for fitting over said middle core leg, a plurality of longitudinal internal ribs (24) being provided on one side of said chimney-like opening for pressing together said laminations at said middle core leg (11*a*).

7. Electrical winding according to claim 3, in which said core is E-shaped, having two outer legs and a middle leg, one of said outer legs being which is free of mounting holes, and the middle leg being a leg on which said cup casing (17) of said winding is slipped on, said cup casing being provided with a chimney-like opening of substantially rectangular cross-section for fitting over said middle core leg, a plurality of longitudinal internal ribs (24) being provided on one side of said chimney-like opening for pressing together said laminations at said middle core leg (11*a*).

8. Electrical winding according to claim 1, in which said core is E-shaped and has a yoke region and three legs, onto the middle one of which said cup casing for said winding is slipped, a first one of said outer legs being said leg which is free of mounting holes, and the second one of said outer legs being grasped by said protuberations of said cup casing, one of said protuberations (19) having at least one longitudinal rib (21) pressing against said last-mentioned core leg.

9. Electrical winding according to claim 2, in which said core is E-shaped and has a yoke region and three legs, onto the middle one of which said cup casing for said winding is slipped, a first one of said outer legs being said leg which is free of mounting holes, and the second one of outer said legs being grasped by said protuberations of said cup casing, one of said protuberations (19) having at least one longitudinal rib (21) pressing against said core last-mentioned leg.

10. Electrical winding according to claim 3, in which said core is E-shaped and has a yoke region and three legs, onto the middle one of which said cup casing for said winding is slipped, a first one of said outer legs being said leg which is free of mounting holes, and the second one of said outer legs being grasped by said protuberations of said cup casing, one of said protuberations (19) having at least one longitudinal rib (21) pressing against said last-mentioned core leg.

11. Electrical winding according to claim 8, in which said cup casing has a substantially rectangular chimney-like opening fitting over said middle core leg (11*a*) provided with internal longitudinal ribs (24) on one side thereof, and in which said middle core leg and said second outer core leg respectively bear against surfaces (23*a*,22) of said cup casing at surfaces of said respective legs which are opposite to the surfaces thereof bearing respectively against said longitudinal ribs (24,21).

12. Electrical winding according to claim 9, in which said cup casing has a substantially rectangular chimney-like opening fitting over said middle core leg (11*a*) provided with internal longitudinal ribs (24) on one side thereof, and in which said middle core leg and said second outer core leg respectively bear against surfaces (23*a*,22) of said cup casing at surfaces of said respective legs which are opposite to the surfaces thereof bearing respectively against said longitudinal ribs (24,21).

13. Electrical winding according to claim 10, in which said cup casing has a substantially rectangular chimney-like opening fitting over said middle core leg (11*a*) provided with internal longitudinal ribs (24) on one side thereof, and in which said middle core leg and said second outer core leg respectively bear against surfaces (23*a*,22) of said cup casing at surfaces of said respective legs which are opposite to the surfaces thereof bearing respectively against said longitudinal ribs (24,21).

14. Electrical winding according to claim 11, in which said surface (24) of said cup casing (17) against which said second outer leg (11*d*) bears is constituted by one of said protuberances of said cup casing (17) which contains a pocket (20) for housing electrical components connected to said winding.

15. Electrical winding according to claim 12, in which said surface (24) of said cup casing (17) against which said second outer leg (11*d*) bears is constituted by one of said protuberances of said cup casing (17) which contains a pocket (20) for housing electrical components connected to said winding.

16. Electrical winding according to claim 13, in which said surface (24) of said cup casing (17) against which said second outer leg (11*d*) bears is constituted by one of said protuberances of said cup casing (17) which contains a pocket (20) for housing electrical components connected to said winding.

* * * * *